US010240343B2

(12) United States Patent
Rivard

(10) Patent No.: US 10,240,343 B2
(45) Date of Patent: Mar. 26, 2019

(54) ROOF RIDGE SHINGLE UNIT AND METHOD OF USING SAME

(71) Applicant: Daniel Rivard, Montreal (CA)

(72) Inventor: Daniel Rivard, Montreal (CA)

( * ) Notice: Subject to any disclaimer, the term of this patent is extended or adjusted under 35 U.S.C. 154(b) by 163 days.

(21) Appl. No.: 15/225,999

(22) Filed: Aug. 2, 2016

(65) Prior Publication Data

US 2017/0037628 A1 Feb. 9, 2017

(30) Foreign Application Priority Data

Aug. 7, 2015 (GB) ..... 1514046.0

(51) Int. Cl.

| | |
|---|---|
| ***E04D 1/30*** | (2006.01) |
| ***E04D 5/00*** | (2006.01) |
| ***E04D 5/14*** | (2006.01) |
| *E04D 1/34* | (2006.01) |
| *E04D 1/36* | (2006.01) |

(52) U.S. Cl.

CPC ..... *E04D 1/30* (2013.01); *E04D 5/00* (2013.01); *E04D 5/14* (2013.01); *E04D 1/3402* (2013.01); *E04D 1/36* (2013.01); *E04D 2001/305* (2013.01); *E04D 2001/3408* (2013.01)

(58) Field of Classification Search

CPC ..... E04D 1/30; E04D 1/3402; E04D 1/36; E04D 5/00; E04D 5/14; E04D 2001/301; E04D 2001/302; E04D 2001/303; E04D 2001/304; E04D 2001/305; E04D 2001/3408; E04D 2001/3411

USPC ..... 52/43, 57, 198, 199, 276, 518, 528, 531, 52/532, 533, 535, 539, 540, 555, 519; 454/250, 260, 364–366

See application file for complete search history.

(56) References Cited

U.S. PATENT DOCUMENTS

| | | | | |
|---|---|---|---|---|
| 1,439,434 A | | 12/1922 | Munro | |
| 1,470,054 A | * | 10/1923 | Broughton | E04B 7/20 52/278 |
| 1,549,723 A | | 8/1925 | Mattison | |
| 1,802,868 A | | 4/1931 | Black | |
| 1,897,139 A | | 2/1933 | Overbury | |
| 2,730,969 A | | 1/1956 | Perry | |
| 5,247,771 A | | 9/1993 | Poplin | |

(Continued)

FOREIGN PATENT DOCUMENTS

JP 64001851 1/1989

*Primary Examiner* — William V Gilbert

(57) ABSTRACT

A roof ridge shingle unit including: a substantially elongated cover element shaped like a plurality of shingles longitudinally overlapping partially each other and having a substantially inverted V-shaped transversal cross-sectional configuration defining a pair of opposed side edges and a zenith ridge extending longitudinally therealong between the side edges, the cover element defining a top surface and an opposed bottom surface, the cover element defining longitudinally opposed first and second ends; and a first end attachment provided substantially adjacent the first end and a second end attachment provided substantially adjacent the second end. The first and second end attachments are configured and sized so that the first end attachment of the roof shingle unit is attachable to the second end attachment of a similar roof shingle units so that the roof ridge shingle units are secured to each other in a predetermined positional relationship relative to each other.

19 Claims, 3 Drawing Sheets

(56) References Cited

U.S. PATENT DOCUMENTS

| | | | | |
|---|---|---|---|---|
| 5,295,340 | A | 3/1994 | Collins | |
| 5,331,783 | A | 7/1994 | Kasner et al. | |
| D366,336 | S | 1/1996 | Noone et al. | |
| 5,651,734 | A | 7/1997 | Morris | |
| 5,934,995 | A | 8/1999 | Morris et al. | |
| D422,095 | S | 3/2000 | Thagard, III et al. | |
| 6,684,581 | B2 | 2/2004 | Robinson et al. | |
| 6,913,530 | B2 | 7/2005 | Morris et al. | |
| D603,981 | S | 11/2009 | King | |
| D617,913 | S | 6/2010 | Shanes et al. | |
| D625,845 | S | 10/2010 | Shanes et al. | |
| D636,501 | S | 4/2011 | Shanes et al. | |
| D656,248 | S | 3/2012 | Tchley | |
| 8,136,316 | B2 * | 3/2012 | Schwarz | E04D 1/265 52/287.1 |
| D660,989 | S | 5/2012 | Tchley | |
| 2005/0262784 | A1 * | 12/2005 | Justice | E04F 13/0864 52/287.1 |
| 2006/0059830 | A1 * | 3/2006 | Perry | E04D 1/30 52/518 |
| 2013/0042540 | A1 * | 2/2013 | Atchley | E04D 1/265 52/57 |
| 2013/0255164 | A1 | 10/2013 | Derreumaux et al. | |
| 2013/0324030 | A1 | 12/2013 | Rotter | |

* cited by examiner

ROOF RIDGE SHINGLE UNIT AND METHOD OF USING SAME

FIELD OF THE INVENTION

The present invention relates generally to roof shingles and, more particularly, to a roof ridge shingle unit for covering the ridge of a roof, a kit including at least two of the roof ridge shingle units and a method of using same.

BACKGROUND

Shingles are commonly used to cover roofs. These shingles are typically flat. Thus, to cover the ridges of pitched roofs, they cannot be used "as is". Instead, ridge cap shingles are used. These ridge cap shingles, are typically obtained by cutting transversally in three identical sections a standard size 36 inches by 12 inches bitumen based three-tab shingle. Each of the three ridge cap shingles thus obtained are then nailed longitudinally in a partially overlapping fashion along the ridge of the roof, after the flat sections thereof have been covered with standard three-tab shingles. This traditional method is however relatively time consuming.

In view of the above, there is a need in the industry for an improved way of covering the ridge of a roof. An object of the present invention is to provide such an improved way in the form of an improved method and of a unit and kit usable to perform the method.

SUMMARY OF THE INVENTION

In a broad aspect, the present invention provides A roof ridge shingle kit, comprising: first and second roof ridge shingle units, each of the first and second roof ridge shingle units including a substantially elongated shingle assembly including a plurality of shingles longitudinally overlapping partially each other, each shingle having a substantially inverted V-shaped transversal cross-sectional configuration and defining a pair of opposed shingle side edges and a shingle zenith ridge extending longitudinally therealong between the shingle side edges, the shingle assembly defining a shingle assembly top surface and an opposed shingle assembly bottom surface, the shingle assembly defining longitudinally opposed shingle assembly first and second ends; and a substantially elongated linking element secured to the shingle assembly and extending longitudinally along at least part of the shingle assembly in register with and below the shingle zenith ridges, the linking element defining a first end attachment provided substantially adjacent the shingle assembly first end and a second end attachment provided substantially adjacent the shingle assembly second end, The first and second end attachments are configured and sized so that with the first end attachment of the first roof ridge shingle unit engaging the second end attachment of the second roof ridge shingle unit with the first and second roof ridge shingle units operatively positioned on a roof ridge longitudinally aligned with each other, the first and second roof ridge shingle units are secured to each other in a predetermined positional relationship relative to each other.

The invention may also provide a roof ridge shingle kit wherein the first end attachment is at the shingle assembly first end and the second end attachment is longitudinally opposed to the first end attachment and retracted from the shingle assembly second end so that when the first end attachment of the first roof ridge shingle unit engages the second end attachment of the second roof ridge shingle unit, the first and second roof ridge shingle units partially overlap each other.

The invention may also provide a roof ridge shingle kit wherein the linking element includes a rod, the first attachment including one of a female portion and a male portion and the second attachment including an other one of the female portion and the male portion, the male and female portions being configured and sized so that the male portion of the first roof ridge shingle unit is insertable into the female portion of the second roof ridge shingle unit.

The invention may also provide a roof ridge shingle kit wherein the linking element includes a rod, the first attachment including a recess extending longitudinally into the rod and the second attachment including a pin protruding longitudinally from the rod, the pin and recess being configured and sized so that the pin of the first roof ridge shingle unit is insertable into the recess of the second roof ridge shingle unit.

The invention may also provide a roof ridge shingle kit wherein the rod defines longitudinally opposed rod first and second ends, the pin protruding from the rod second end, the rod second end being distanced from the shingle assembly second end by a distance equivalent to an overlap between adjacent ones of the shingles in the shingle assembly.

The invention may also provide a roof ridge shingle kit wherein the pin is sized to substantially snugly fit into the recess.

The invention may also provide a roof ridge shingle kit wherein the rod has a substantially circular transversal cross-sectional configuration.

The invention may also provide a roof ridge shingle kit wherein the rod has a substantially triangular transversal cross-sectional configuration.

The invention may also provide a roof ridge shingle kit further comprising a roofing membrane extending parallel to the shingle assembly bottom surface and secured to the shingle assembly.

The invention may also provide a roof ridge shingle kit wherein the linking element is between the roofing membrane and the shingle assembly bottom surface.

The invention may also provide a roof ridge shingle kit wherein the roofing membrane is between the linking element and the shingle assembly bottom surface.

The invention may also provide a roof ridge shingle kit wherein the roofing membrane protrudes longitudinally from at least one of the shingle assembly first and second ends.

The invention may also provide a roof ridge shingle kit further comprising a reinforcement structure between the roofing membrane and the shingle assembly bottom surface.

The invention may also provide a roof ridge shingle kit wherein the reinforcement structure is mesh-like.

The invention may also provide a roof ridge shingle kit further comprising a junction shingle unit, the junction shingle unit having one of a "L", "X" and "T" shaped configuration, the first and second roof ridge shingle units being attachable to the junction shingle unit.

The invention may also provide a roof ridge shingle kit wherein the shingles within the shingle assembly are bond to each other.

In another broad aspect, the invention provides a roof ridge shingle unit, comprising: a substantially elongated shingle assembly including a plurality of shingles longitudinally overlapping partially each other, each shingle having a substantially inverted V-shaped transversal cross-sectional configuration and defining a pair of opposed shingle side edges and a shingle zenith ridge extending longitudinally therealong between the shingle side edges, the shingle assembly defining a shingle assembly top surface and an opposed shingle assembly bottom surface, the shingle assembly defining longitudinally opposed shingle assembly first and second ends; and a substantially elongated linking element secured to the shingle assembly and extending longitudinally along at least part of the shingle assembly in register with and below the shingle zenith ridges, the linking element defining a first end attachment provided substantially adjacent the shingle assembly first end and a second end attachment provided substantially adjacent the shingle assembly second end. The first and second end attachments are configured and sized so that the first end attachment of the roof ridge shingle unit is attachment to the second end attachment of a similar roof ridge shingle units so that the roof ridge shingle units are secured to each other in a predetermined positional relationship relative to each other.

In yet another broad aspect, the invention provides a roof ridge shingle unit, comprising: a substantially elongated cover element shaped like a plurality of shingles longitudinally overlapping partially each other, the cover element having a substantially inverted V-shaped transversal cross-sectional configuration and defining a pair of opposed side edges and a zenith ridge extending longitudinally therealong between the side edges, the cover element defining a top surface and an opposed bottom surface, the cover element defining longitudinally opposed first and second ends; and a first end attachment provided substantially adjacent the first end and a second end attachment provided substantially adjacent the second end. The first and second end attachments are configured and sized so that the first end attachment of the roof shingle unit is attachable to the second end attachment of a similar roof shingle units so that the roof ridge shingle units are secured to each other in a predetermined positional relationship relative to each other.

The present application claims benefit from UK request application 1514046.0 filed Aug. 7, 2015, the contents of which is hereby incorporated by reference in its entirety.

Other objects, advantages and features of the present invention will become more apparent upon reading of the following non-restrictive description of some embodiments thereof, given by way of example only with reference to the accompanying drawings.

DETAILED DESCRIPTION

The term "substantially" is used throughout this document to indicate variations in the thus qualified terms. These variations are variations that do not materially affect the manner in which the invention works and can be due, for example, to uncertainty in manufacturing processes or to small deviations from a nominal value or ideal shape that do not cause significant changes to the invention. These variations are to be interpreted from the point of view of the person skilled in the art. Also, directional terminology, such as top and bottom, refers to the roof ridge single unit of the invention oriented as installed on a roof ridge. This reference configuration is used for reference and convenience purposes and should not be used to restrict the scope of the claims unless explicitly required by the structure of a specific claim.

Figure 13:
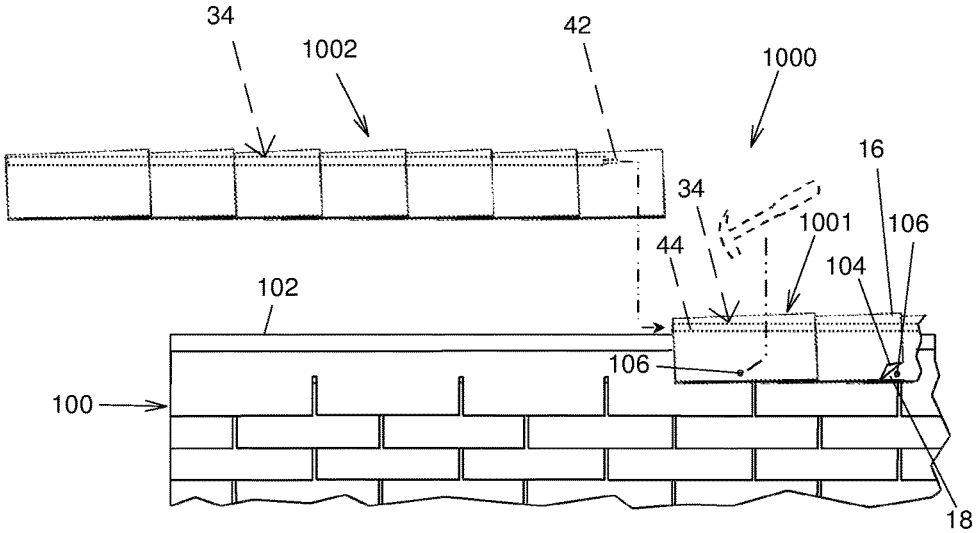
FIG. 13, in a side elevation view, illustrates a first step in the installation of the roof ridge shingle unit of FIG. 1 on the ridge of a roof on which there is already an other roof ridge shingle unit installed.
Figure 14:
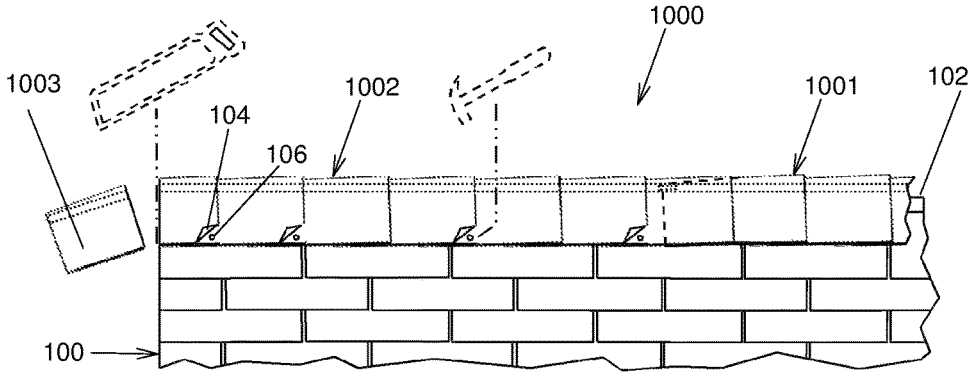
FIG. 14, in a side elevation view, illustrates a second step in the installation of the roof ridge shingle unit of FIG. 1 on the ridge of a roof on which there is already an other roof ridge shingle unit installed.

FIGS. 1, 2 and 4 to 8 illustrate various aspects of an embodiment, according to the present invention, of a roof ridge shingle unit 10 for covering the ridge 102 of a pitched roof 100, as exemplified in FIGS. 13 and 14. FIGS. 13 and 14 illustrate a roof ridge shingle kit 1000 including first and second roof ridge shingle units 1001 and 1002, each similar to the roof ridge shingle unit 10. Although roof ridge shingle kits 1000 including only two roof ridge shingle units 1001 and 1002 are within the scope of the invention, the roof ridge shingle kit 1000 typically includes more than two roof ridge shingle units 10

Figure 2:
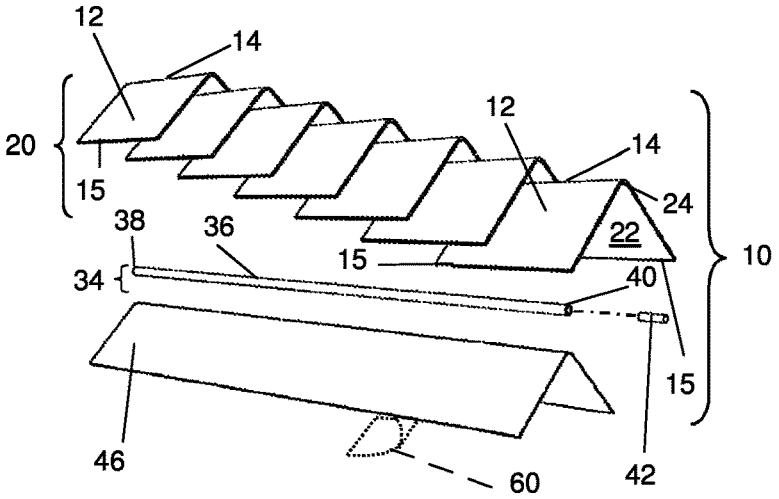
FIG. 2, in a perspective exploded view, illustrates the roof ridge shingle unit of FIG. 1.
Figure 4:
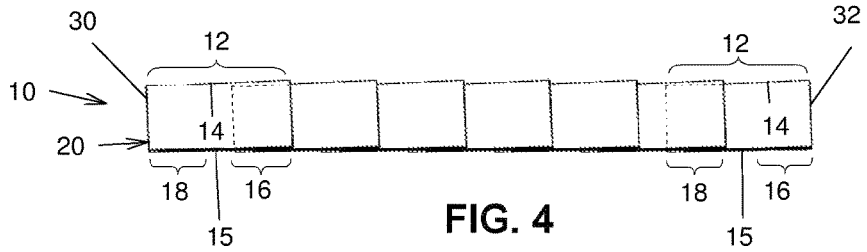
FIG. 4, in a side elevational view, illustrates the roof ridge shingle unit of FIG. 1

Referring for example to FIG. 2, the roof ridge shingle unit 10 includes a substantially elongated shingle assembly 20 including a plurality of shingles 12 longitudinally overlapping partially each other. Each one in the shingles 12 has a substantially inverted V-shaped transversal cross-sectional configuration and defines a pair of opposed shingle side edges 15 and a shingle zenith ridge 14 extending longitudinally therealong between the shingle side edges 15. Referring more particularly to FIG. 4, each shingle 12 further defines a shingle overlapping end portion 16 and a shingle overlapped end portion 18 at opposed longitudinal ends thereof.

The shingles 12 are assembled in a partially longitudinally overlapping fashion, with a shingle overlapping end portion 16 of a first shingle 12 overlapping the shingle overlapped end portion 18 of a second shingle 12, thus cooperatively forming a longitudinally extending shingle assembly 20.

It should be noted that in alternative embodiments, the shingle assembly 20 may be replaced by a similarly shaped cover element that is made of a single piece of material having a shape similar to the shingle assembly 20.

Figure 7:
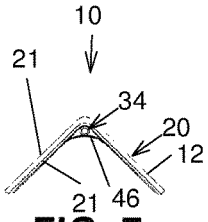
FIG. 7, in a first end elevational view, illustrates the roof ridge shingle unit of FIG. 1.
Figure 8:
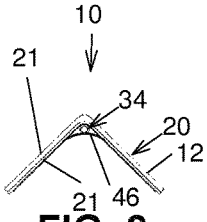
FIG. 8, in a second end elevational view, opposite the one of FIG. 7, illustrates the roof ridge shingle unit of FIG. 1.

Referring for example to FIG. 7, the thus assembled shingle assembly 20 defines a shingle assembly top surface 21 and an opposed shingle assembly bottom surface 22, the latter defining a shingle assembly underside fold line 24 extending substantially centrally longitudinally relative thereto.

Figure 5:
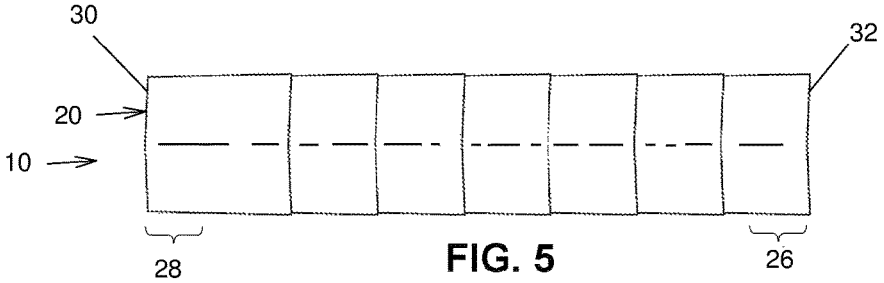
FIG. 5, in a top plan view, illustrates the roof ridge shingle unit of FIG. 1.
Figure 6:
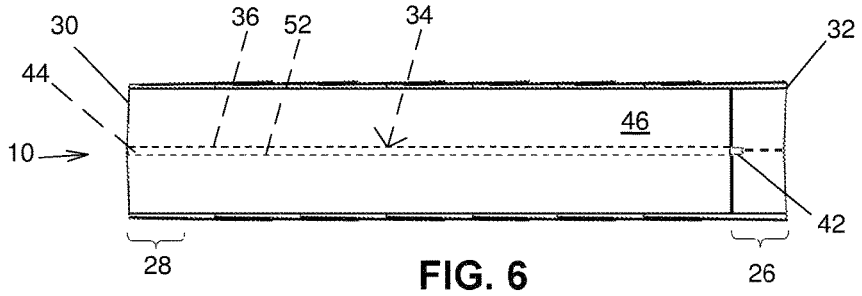
FIG. 6, in a bottom plan view, illustrates the roof ridge shingle unit of FIG. 1.

Furthermore, as illustrated for example in FIGS. 5 and 6, the shingle assembly 20 defines longitudinally opposed shingle assembly first and second ends 30 and 32. Furthermore, the shingle assembly 20 defines a shingle assembly overlapping portion 26 and a shingle assembly overlapped portion 28 respectively at the shingle assembly second and first ends 32 and 30.

Figure 1:
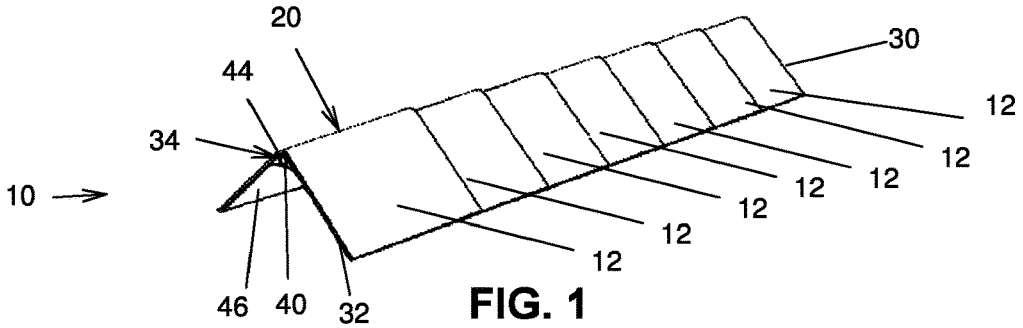
FIG. 1, in a perspective view, illustrates an embodiment of a roof ridge shingle unit, according to the present invention.

Now referring more particularly to FIGS. 1, 2 and 6, the roof ridge shingle unit 10 further includes a substantially elongated linking element 34 secured to the shingle assembly 20 and extending longitudinally along at least part of the shingle assembly 20 in register with and below the shingle zenith ridges 14. For example, referring to FIG. 2, the linking element 34 includes a substantially elongated rod 36 defining a rod first end 38 and an opposed rod second end 40. The rod 36 is longitudinally engaged in the shingle assembly underside fold line 24. However, the linking element may be any other suitable elongated element having any suitable cross-sectional configuration, such as an inverted V-shaped configuration, and a flat configuration, among others. The linking element 34 may be made of an aluminum material or a substantially rigid polymeric material. Other sufficiently rigid materials are possible.

The linking element 34 defines a first end attachment provided substantially adjacent the shingle assembly first end 30 and a second end attachment provided substantially adjacent the shingle assembly second end 32. The first and second end attachments are configured and sized so that with the first end attachment of the first roof ridge shingle unit 1001 engaging the second end attachment of the second roof ridge shingle unit 1002 with the first and second roof ridge shingle units 1001 and 1002 operatively positioned on a ridge 102 of a roof 100 longitudinally aligned with each other, the first and second roof ridge shingle units 1001 and 1002 are secured to each other in a predetermined positional relationship relative to each other. This allows assembly of the roof ridge shingle kit 1000 relatively quickly.

In some embodiments, the first end attachment is at the shingle assembly first end 30 and the second end attachment is longitudinally opposed to the first end attachment and retracted from the shingle assembly second end 32 so that when the first end attachment of the first roof ridge shingle unit 1001 engages the second end attachment of the second roof ridge shingle unit 1002, the first and second roof ridge shingle units 1001 and 1002 partially overlap each other, as seen in FIG. 14.

It should be noted that in alternative embodiments (not shown in the drawings), attachments are provided at the shingle assembly first and second ends 30 and 32 in any other suitable manner. For example, and non-limitingly, first and second attachments may be directly supported by the shingle assembly 20, and not by the linking element 34. Such attachments may take for example the form of complementary hooks and hook attachments, for example D-rings. They could also take the form of a pin and a sleeve defining a recess that are complementarily shaped to attach to each other. Any other suitable first and second attachments are also within the scope of the invention.

In a specific embodiment of the invention, the first and second attachments are as follows. The first attachment includes a recess 44, as seen for example in FIG. 1, extending longitudinally into the rod 36 and the second attachment includes a pin 42, as seen for example in FIG. 2, protruding longitudinally from the rod 36, longitudinally opposed to the recess 44. The pin 42 and recess 44 are configured and sized so that the pin 42 of the roof ridge shingle unit 10 is insertable into the recess 44 of another roof ridge shingle unit 10. In a specific embodiment of the invention, the pin 42 is sized to substantially snugly fit into the recess 44.

In a specific embodiment of the invention, the recess 44 is at the rod first end 38 and the pin 42 protrudes from the rod second end 40. Typically, the rod second end 40 is distanced from the shingle assembly second end 30 by a distance equivalent to an overlap between adjacent ones of the shingles 12 in the shingle assembly 20.

In some embodiments, the shingles 12 are bound to each other to form the shingle assembly 20, and the rod 36 is bound to the shingle assembly 20. However, in alternative embodiments, the shingles 12 are only bound or otherwise secured to the rod 36, and not to each other.

Thus more than one roof ridge shingle unit 10 may be longitudinally assembled in a daisy chain fashion along the ridge 102 or hip of a pitched roof 100. As sequentially illustrated in FIGS. 13 and 14, a method of using the roof ridge shingle unit 10 of the present invention is typically as follows.

In a first step, as seen in FIG. 13, the first roof ridge shingle unit 1001 is installed longitudinally on the ridge 102 of the roof 100. In a second step, a corner 104 of selected ones of the or all individual shingles 12 on both sides of the first roof ridge shingle unit 1001 are slightly lifted in order to hammer a roofing nail 106 through the shingle overlapped end portion 18 of the underlying shingle 12. Thus, the first roof ridge shingle unit 1001 is firmly anchored to the ridge 102 of the roof 100.

A third step includes longitudinally positioning the second roof ridge shingle unit 1002 slightly above a portion of the ridge 102 adjacent the recess 44 of the first roof ridge shingle unit 1001, followed with engaging the pin 42 of the second roof ridge shingle unit 1002 therewith to achieve the configuration shown in FIG. 14.

A fourth step, likewise in the second step described above, includes slightly lifting a corner 104 of selected, or all, shingles 12 on both sides of the second roof ridge shingle unit 1002 in order to hammer a roofing nail 106 through the shingle overlapped end portion 18 of the underlying shingle 12.

In some embodiments, a fifth step includes cutting the exceeding length portion 1003 of the second roof ridge shingle unit 1002, for example, at an end of the ridge 102 of the roof 100.

As best illustrated in FIGS. 2 and 6, the roof ridge shingle unit 10 may further include in some embodiments a roofing membrane 46 extending parallel to the shingle assembly bottom surface 22 and secured to the shingle assembly 20. Typically, the roofing membrane 46 has a suitable shape and dimensions for substantially covering the width dimension of the shingle assembly 20 and a length similar to the length of the rod 36.

In some embodiments, the roofing membrane 46 is coplanarly bonded to the shingle assembly bottom surface 22 using an adhesive so as to have the rod 36 embedded therebetween. Thus, in these embodiments, the linking element 34 is between the roofing membrane 46 and the shingle assembly bottom surface 22.

Figure 3:
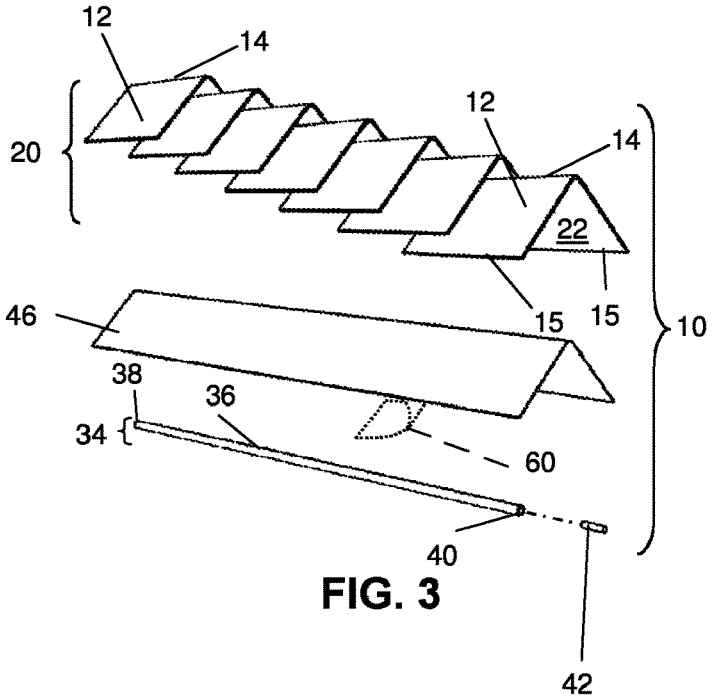
FIG. 3, in a perspective exploded view, illustrates an alternate embodiment of a roof ridge shingle unit, according to the present invention.

In an alternate embodiment of a roof ridge shingle unit 1004, as illustrated in FIG. 3, the roofing membrane 46 has a suitable shape and dimensions for substantially covering the shingle assembly bottom surface 22. Furthermore, the roofing membrane 46 is coplanarly bonded to the shingle assembly bottom surface 22 and the rod 36 is provided below the roofing membrane 46. Thus, in these embodiments, the roofing membrane 46 is between the linking element 34 and the shingle assembly bottom surface 22.

The roofing membrane 46 may be represented by any type of commercially available roofing membrane. Commercially available types of roofing membrane are, for example, a thermoset membrane, a thermoplastic membrane, and a modified bitumen membrane. Other types of roofing membranes are also possible.

Figure 11:
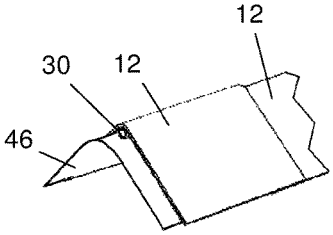
FIG. 11, in a perspective partial view, illustrates yet another alternate embodiment of a roof ridge shingle unit, according to the present invention.

In some embodiments, as illustrated in FIG. 11, the roofing membrane protrudes longitudinally from at least one of the shingle assembly first and second ends 30 and 32, here from the shingle assembly first end 30. Thus, an end portion of the roofing membrane 46 adjacent the rod second end 40 (e.g. adjacent the pin 42) of one roof ridge shingle unit 10 may overlap the portion of the roofing membrane 46 protruding from the shingle assembly second end 32 of another roof ridge shingle unit 10 for a more secure impermeable seal at the junction between two roof ridge shingle units 10.

The first and second attachments may differ from the pin 42 and recess 44. For example, the first attachment includes one of a female portion and a male portion and the second attachment including an other one of the female portion and the male portion, the male and female portions being configured and sized so that the male portion of the first roof ridge shingle unit is insertable into the female portion of the second roof ridge shingle unit.

In some embodiments, the recess 44 is part of a passageway 52 that extends throughout the rod 36, as seen in FIG. 6. Thus, the pin 42 may have one end portion fixedly engaged in the passageway 52 at the rod second end 40.

It is to be understood that, in an alternate embodiment of the roof ridge shingle unit (not shown in the figures), the pin 42 may have one end fixedly engaged in the passageway 52 at the rod first end 38, so as to have the opening of the passageway 52 at the opposed end thereof defining the recess 44.

Bonding between the various elements of the roof ridge shingle unit 10 may be represented by any one of, or a suitable combination of, a cold-applied bitumen based coating, a hot-applied bitumen based coating, a thermal bonding process, a glue coating, a vulcanization bonding process and a double-side adhesive tape, among others. It should be noted that the shingles 12 may be bond to each other over most or all of their overlap, or in other embodiments, may be bond to each other over only part of their overlap. Likewise, the whole length of the rod 36 may be bound to the shingle assembly 20, or only portions of the rod 36 may be bound to the shingle assembly 20.

In a specific embodiment, the bonding is achieved through suitable cold-applied bitumen based coating commonly used in the roofing industry. Often, this type of bonding means is covered with a peel-off film 60 until use, such as illustrated in FIGS. 2 and 3.

Figure 12:
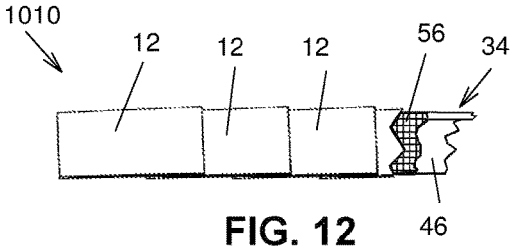
FIG. 12, in a cut away side elevational view, illustrates yet another alternate embodiment of a roof ridge shingle unit, according to the present invention.

In an alternate embodiment of a roof ridge shingle unit 1010, as illustrated in FIG. 12, the roof ridge shingle unit 1010 is similar to the previously described embodiment. The main difference of the presently described embodiment resides in that the latter further includes a reinforcement structure 56. The reinforcement structure 56 has for example a relatively thin sheet-like mesh configuration that can be made of any suitably rigid and rust proof material such as, for example, aluminum, rust treated steel or a substantially rigid polymeric material.

The reinforcement structure 56 has shape configuration and dimensions that are substantially equivalent to the shingle assembly 20. Furthermore, the reinforcement structure 56 is provided between the roofing membrane 46 and the shingle assembly bottom surface 22 (not seen in FIG. 12) and is typically bound to the shingle assembly 20 and the roofing membrane 46.

Alternatively, the linking element 34 and the reinforcement structure 56 may be represented by a single piece element made of a substantially rigid polymeric material using an injection molding process.

Figure 9:
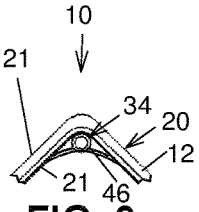
FIG. 9, in a partial and enlarged end elevational view, illustrates the roof ridge shingle unit of FIG. 1.
Figure 10:
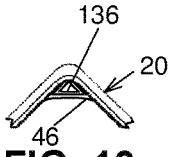
FIG. 10, in a partial and enlarged end elevational view, illustrates another alternate embodiment of a roof ridge shingle unit, in accordance with the present invention.

The rod 36, the pin 42 and the recess 44 define compatibly shaped transversal cross-sections having, in some embodiments, a substantially circular shaped configuration, as best illustrated in FIG. 9. In other embodiments, these transversal cross-sections are substantially triangular shaped configuration, as illustrated in FIG. 10 for the alternative rod 136, which has correspondingly shaped pin and recess. As best illustrated in FIGS. 7 to 10 inclusively, the rod 36 has typically an overall diameter that is suitably sized and shaped so as to not significantly alter the inverted V-shaped configuration of the roof ridge shingle unit 10 once installed on the ridge of a roof.

Each one in the shingles 12 used in the shingle assembly 20 used in the present invention may be represented by any type of suitably shaped and sized shingle 12 commonly available on the market. Commonly available types of roofing shingles are, for example, an organic mat-based shingle, a fiberglass mat-based shingle, a wood shake, a ceramic tile and a slate tile.

As would be obvious to someone familiar with roofing techniques, the shingles 12 of the present invention may be obtained by suitably cutting into three individual sections a standard 36 inches by 12 inches three-tab shingle. These cut out shingles 12 typically have a cold-applied bitumen based coating in the form of individual patches 108 along their shingle overlapped portion 18, as illustrated in an alternate embodiment of the present invention in FIG. 18. The use of shingles 12 allows a perfect color and texture match between the standard roofing shingles used for covering the flat sections and the ridges 102 of a pitched roof 100. Alternatively, the shingles 12 or whole shingle assemblies 20 may be prefabricated using conventional manufacturing techniques.

The roof ridge shingle unit 10 has for example a length dimension of a standard three-tabs roofing shingle, which is typically about 36 inches. The roof ridge shingle unit 10 may also be provided in lengths of about 48 inches for efficient stacking on standard four (4) feet square transport palettes. However, any other suitable length is within the scope of the present invention.

Figure 15:
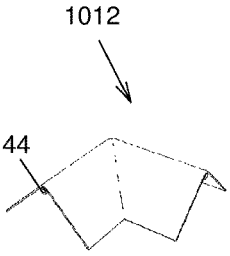
FIG. 15, in a perspective view, illustrates a first embodiment of a junction shingle unit usable with the roof ridge shingle unit of FIG. 1 and usable for covering a roof ridge junctions that may be part of a pitched roof.
Figure 16:
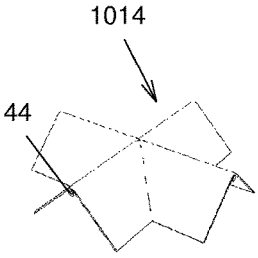
FIG. 16, in a perspective view, illustrates a second embodiment of a junction shingle unit usable with the roof ridge shingle unit of FIG. 1 and usable for covering a roof ridge junctions that may be part of a pitched roof.
Figure 17:
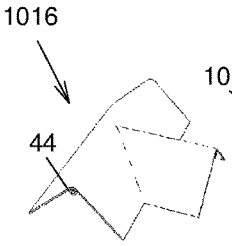
FIG. 17, in a perspective view, illustrates a third embodiment of a junction shingle unit usable with the roof ridge shingle unit of FIG. 1 and usable for covering a roof ridge junctions that may be part of a pitched roof.
Figure 18:
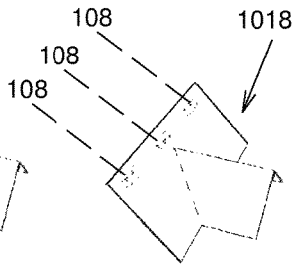
FIG. 18, in a perspective view, illustrates a fourth embodiment of a junction shingle unit usable with the roof ridge shingle unit of FIG. 1 and usable for covering a roof ridge junctions that may be part of a pitched roof.

As would be obvious to someone familiar with commercially available roofing materials, the roof ridge shingle unit 10 of the present invention may be usable with a junction shingle units used for covering various configurations of roof ridge junctions. For examples, as illustrated in FIGS. 15, 16 and 17 respectively, the junction shingle units 1012, 1014 and 1016 may have a substantially "L", "X", or "T" shaped configuration respectively, for covering the most commonly encountered roof ridge junctions. The junction shingle units 1012, 1014 and 1016 have a structure similar to the roof ridge shingle unit 10, and typically include a recess 44 for receiving the pins 42 along each "arm" of the junction shingle units 1012, 1014 and 1016. FIG. 18 illustrates another roof ridge junction unit 1018 for typically covering the ridge junction of a dormer window with a pitched roof. Other common roof ridge junction configurations are also within the scope of the invention.

In these examples, the linear portions of the junction shingle units 1012, 1014, 1016 and 1018 have only one shingle 12 in each direction. It is to be understood that more than one shingle 12 may be linearly assembled in each directions. Furthermore, each configuration includes a linking element 34 and a roofing membrane (not visible in the figures) as described in the embodiments further above.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole. The present invention can thus be modified without departing from the spirit and nature of the subject invention as defined in the appended claims.

What is claimed is:

1. A roof ridge shingle kit, comprising:

first and second roof ridge shingle units, each of the first and second roof ridge shingle units including a substantially elongated shingle assembly including a plurality of shingles longitudinally overlapping partially each other, each of the plurality of shingles having a substantially inverted V-shaped transversal cross-sectional configuration and defining a pair of opposed shingle side edges and a shingle zenith ridge extending longitudinally therealong between the shingle side edges, the shingle assembly defining a shingle assembly top surface and an opposed shingle assembly bottom surface, the shingle assembly defining longitudinally opposed shingle assembly first and second ends; and a substantially elongated linking element secured to the shingle assembly and extending longitudinally along at least part of the shingle assembly in register with and below the shingle zenith ridges, the linking element defining a first end attachment provided substantially adjacent the shingle assembly first end and a second end attachment provided substantially adjacent the shingle assembly second end;

wherein the first and second end attachments are configured and sized so that with the first end attachment of the first roof ridge shingle unit engaging the second end attachment of the second roof ridge shingle unit with the first and second roof ridge shingle units operatively positioned on a roof ridge longitudinally aligned with each other, the first and second roof ridge shingle units are secured to each other in a predetermined positional relationship relative to each other.

2. The roof ridge shingle kit as defined in claim 1, wherein the first end attachment is at the shingle assembly first end and the second end attachment is longitudinally opposed to the first end attachment and retracted from the shingle assembly second end so that when the first end attachment of the first roof ridge shingle unit engages the second end attachment of the second roof ridge shingle unit, the first and second roof ridge shingle units partially overlap each other.

3. The roof ridge shingle kit as defined in claim 2, wherein the linking element includes a rod, the first attachment including one of a female portion and a male portion and the second attachment including an other one of the female portion and the male portion, the male and female portions being configured and sized so that the male portion of the first roof ridge shingle unit is insertable into the female portion of the second roof ridge shingle unit.

4. The roof ridge shingle kit as defined in claim 2, wherein the linking element includes a rod, the first attachment including a recess extending longitudinally into the rod and the second attachment including a pin protruding longitudinally from the rod, the pin and recess being configured and sized so that the pin of the first roof ridge shingle unit is insertable into the recess of the second roof ridge shingle unit.

5. The roof ridge shingle kit as defined in claim 4, wherein the rod defines longitudinally opposed rod first and second ends, the pin protruding from the rod second end, the rod second end being distanced from the shingle assembly second end by a distance equivalent to an overlap between adjacent ones of the shingles in the shingle assembly.

6. The roof ridge shingle kit as defined in claim 4, wherein the pin is sized to substantially snugly fit into the recess.

7. The roof ridge shingle kit as defined in claim 4, wherein the rod has a substantially circular transversal cross-sectional configuration.

8. The roof ridge shingle kit as defined in claim 4, wherein the rod has a substantially triangular transversal cross-sectional configuration.

9. The roof ridge shingle kit as defined in claim 1, further comprising a roofing membrane extending parallel to the shingle assembly bottom surface and secured to the shingle assembly.

10. The roof ridge shingle kit as defined in claim 9, wherein the linking element is between the roofing membrane and the shingle assembly bottom surface.

11. The roof ridge shingle kit as defined in claim 9, wherein the roofing membrane is between the linking element and the shingle assembly bottom surface.

12. The roof ridge shingle kit as defined in claim 9, wherein the roofing membrane protrudes longitudinally from at least one of the shingle assembly first and second ends.

13. The roof ridge shingle kit as defined in claim 9, further comprising a reinforcement structure between the roofing membrane and the shingle assembly bottom surface.

14. The roof ridge shingle kit as defined in claim 13, wherein the reinforcement structure is a mesh.

15. The roof ridge shingle kit as defined in claim 1, further comprising a junction shingle unit, the junction shingle unit having one of a "L", "X" and "T" shaped configuration, the first and second roof ridge shingle units being attachable to the junction shingle unit.

16. The roof ridge shingle kit as defined in claim 1, wherein the shingles within the shingle assembly are bonded to each other.

17. A roof ridge shingle unit, comprising:

a substantially elongated shingle assembly including a plurality of shingles longitudinally overlapping partially each other, each of the plurality of shingles having a substantially inverted V-shaped transversal cross-sectional configuration and defining a pair of opposed shingle side edges and a shingle zenith ridge extending longitudinally therealong between the shingle side edges, the shingle assembly defining a shingle assembly top surface and an opposed shingle assembly bottom surface, the shingle assembly defining longitudinally opposed shingle assembly first and second ends; and a substantially elongated linking element secured to the shingle assembly and extending longitudinally along at least part of the shingle assembly in register with and below the shingle zenith ridges, the linking element defining a first end attachment provided substantially adjacent the shingle assembly first end and a second end attachment provided substantially adjacent the shingle assembly second end;

wherein the first and second end attachments are configured and sized so that the first end attachment of the roof ridge shingle unit is attached to the second end attachment of a similar roof ridge shingle units so that the roof ridge shingle units are secured to each other in a predetermined positional relationship relative to each other.

18. A roof ridge shingle unit, comprising:

a substantially elongated cover element shaped like a plurality of shingles longitudinally overlapping partially each other, the cover element having a substantially inverted V-shaped transversal cross-sectional configuration and defining a pair of opposed side edges and a zenith ridge extending longitudinally therealong between the side edges, the cover element defining a top surface and an opposed bottom surface, the cover element defining longitudinally opposed first and second ends; and a first end attachment provided substantially adjacent the first end and a second end attachment provided substantially adjacent the second end;

wherein the first and second end attachments are configured and sized so that the first end attachment of the roof ridge shingle unit is attachable to the second end attachment of a similar roof ridge shingle unit so that the roof ridge shingle units are secured to each other in a predetermined positional relationship relative to each other;

wherein the first end attachment is at the first end and the second end attachment is longitudinally opposed to the first end attachment and retracted from the second end; and wherein the first attachment includes a recess extending longitudinally into the roof ridge shingle unit and the second attachment including a pin protruding longitudinally, the pin and recess being configured and sized so that the pin of the roof ridge shingle unit is insertable into the recess of the similar roof ridge shingle unit.

19. The roof ridge shingle unit as defined in claim 18, wherein the pin is sized to substantially snugly fit into the recess.

* * * * *